US008336869B2

(12) United States Patent
Fukatsu et al.

(10) Patent No.: US 8,336,869 B2
(45) Date of Patent: Dec. 25, 2012

(54) SHEET PROCESSING APPARATUS AND IMAGE FORMING APPARATUS

(75) Inventors: Yasuo Fukatsu, Abiko (JP); Hitoshi Kato, Toride (JP); Naoki Ishikawa, Kashiwa (JP); Tomoharu Sato, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/420,292

(22) Filed: Mar. 14, 2012

(65) Prior Publication Data

US 2012/0169003 A1 Jul. 5, 2012

Related U.S. Application Data

(63) Continuation of application No. 13/044,319, filed on Mar. 9, 2011, now Pat. No. 8,162,303.

(30) Foreign Application Priority Data

Mar. 11, 2010 (JP) ..... 2010-054729

(51) Int. Cl.
*B65H 37/06* (2006.01)

(52) U.S. Cl. ..... 270/45; 270/32; 270/39.08; 493/444; 493/445

(58) Field of Classification Search ..... 270/32, 270/45, 39.08; 493/444, 445
See application file for complete search history.

(56) References Cited

U.S. PATENT DOCUMENTS

| | | | | |
|---|---|---|---|---|
| 5,120,291 | A * | 6/1992 | Wada et al. | 493/23 |
| 5,876,027 | A * | 3/1999 | Fukui et al. | 270/51 |
| 6,712,349 | B2 * | 3/2004 | Watanabe | 270/37 |
| 6,921,069 | B2 * | 7/2005 | Suzuki et al. | 271/207 |
| 7,137,944 | B2 * | 11/2006 | Suzuki et al. | 493/405 |
| 7,883,079 | B2 * | 2/2011 | Sato et al. | 270/32 |
| 7,892,161 | B2 * | 2/2011 | Oshiro et al. | 493/445 |
| 7,926,799 | B2 * | 4/2011 | Iguchi | 270/45 |
| 7,984,896 | B2 * | 7/2011 | Kawaguchi | 270/32 |
| 8,162,303 | B2 * | 4/2012 | Fukatsu et al. | 270/45 |
| 2005/0277537 | A1 * | 12/2005 | Matsushita | 493/444 |
| 2009/0221412 | A1 * | 9/2009 | Kawaguchi | 493/444 |

* cited by examiner

*Primary Examiner* — Patrick Mackey
(74) *Attorney, Agent, or Firm* — Canon USA, Inc., IP Division

(57) ABSTRACT

A sheet processing apparatus includes a folding roller pair, a sheet pushing member, a detection unit, and a control unit. The folding roller pair folds a sheet or a sheet bundle by a nip portion and conveys a folded sheet or a folded sheet bundle. The sheet pushing member performs a pushing operation in which a tip of the sheet pushing member pushes the sheet or the sheet bundle into the nip portion of the folding roller pair. The detection unit detects whether the tip of the sheet pushing member reaches a predetermined position in a moving direction of the sheet pushing member. The control unit controls driving of the sheet pushing member according to a result of detection by the detection unit such that the sheet pushing member repeats the pushing operation until the detection unit detects that the tip of the sheet pushing member reaches the predetermined position.

8 Claims, 12 Drawing Sheets

SHEET PROCESSING APPARATUS AND IMAGE FORMING APPARATUS

CROSS REFERENCE TO RELATED APPLICATIONS

The present application is a continuation of U.S. patent application Ser. No. 13/044,319, filed on Mar. 9, 2011, which claims priority from Japanese Patent Application No. 2010-054729, filed Mar. 11, 2010, all of which are hereby incorporated by reference herein in their entirety.

BACKGROUND OF THE INVENTION

1. Field of the Invention

The present invention relates to a sheet processing apparatus configured to perform folding processing of a sheet or a sheet bundle, and particularly to a sheet processing apparatus configured to perform folding processing to a sheet on which an image has been formed. The present invention relates to a sheet processing apparatus particularly without requiring complicated processing and capable of performing excellent folding processing even if a sheet bundle is thick or a large number of sheets is present.

2. Description of the Related Art

Conventionally, a sheet processing apparatus has been used which is equipped on an image forming apparatus, such as a copying machine or a laser beam printer, to perform processing such as binding after sheet are stacked and folding into a booklet form after sheets on which an image has been formed, which are discharged from an image forming apparatus main body, are successively received. For example, a sheet processing apparatus has been known which pushes the center of a sheet bundle by a pushing plate to fold the sheet bundle, presses the sheet bundle into the nip portion of a roller pair, and conveys and discharges the sheet bundle folded in two, thereby performing saddle stitch bookbinding processing.

In such a sheet processing apparatus, when the number of sheets is large, or a high-stiffness sheet is included in the sheet bundle, in a case where the sheet bundle is pushed by the pushing plate one time to be folded and is made to pass through the nip portion of the roller pair, the state of fold in the folded portion may not be sufficient. Consequently, a sheet processing apparatus is proposed in which a pushing plate or a folding roller pair performs a plurality of folding operations according to the number of sheets or the like. U.S. Pat. No. 5,876,027 discusses a configuration in which when the thickness of the sheet bundle or the number of sheets is equal to or less than a predetermined value, the sheet bundle is pushed only one time by a pushing plate and when it is larger than the predetermined value, the sheet bundle is pushed a plurality of times by the pushing plate.

However, the stiffness of a sheet bundle does not necessarily accurately correspond to the thickness of the sheet bundle or the number of sheets on one-to-one. Accordingly, in the above-described conventional sheet processing apparatus, the determined number of times of pushing may be excessive or insufficient.

SUMMARY OF THE INVENTION

The present invention is directed to a sheet processing apparatus capable of excellent folding processing with the number of times of pushing optimized according to the stiffness of a sheet bundle.

According to an aspect of the present invention sheet processing apparatus includes a folding roller pair configured to fold a sheet or a sheet bundle by a nip portion and to convey a folded sheet or a folded sheet bundle, a sheet pushing member configured to perform a pushing operation in which a tip of the sheet pushing member pushes the sheet or the sheet bundle into the nip portion of the folding roller pair, a detection unit configured to detect whether the tip of the sheet pushing member reaches a predetermined position in a moving direction of the sheet pushing member, and a control unit configured to control driving of the sheet pushing member according to a result of detection by the detection unit such that the sheet pushing member repeats the pushing operation until the detection unit detects that the tip of the sheet pushing member reaches the predetermined position.

According to an exemplary embodiment of the present invention, regardless of the thickness of a sheet bundle or the number of sheets, a sheet bundle can securely be pressed into a nip portion of a folding roller pair, so that excellent folding processing can be performed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
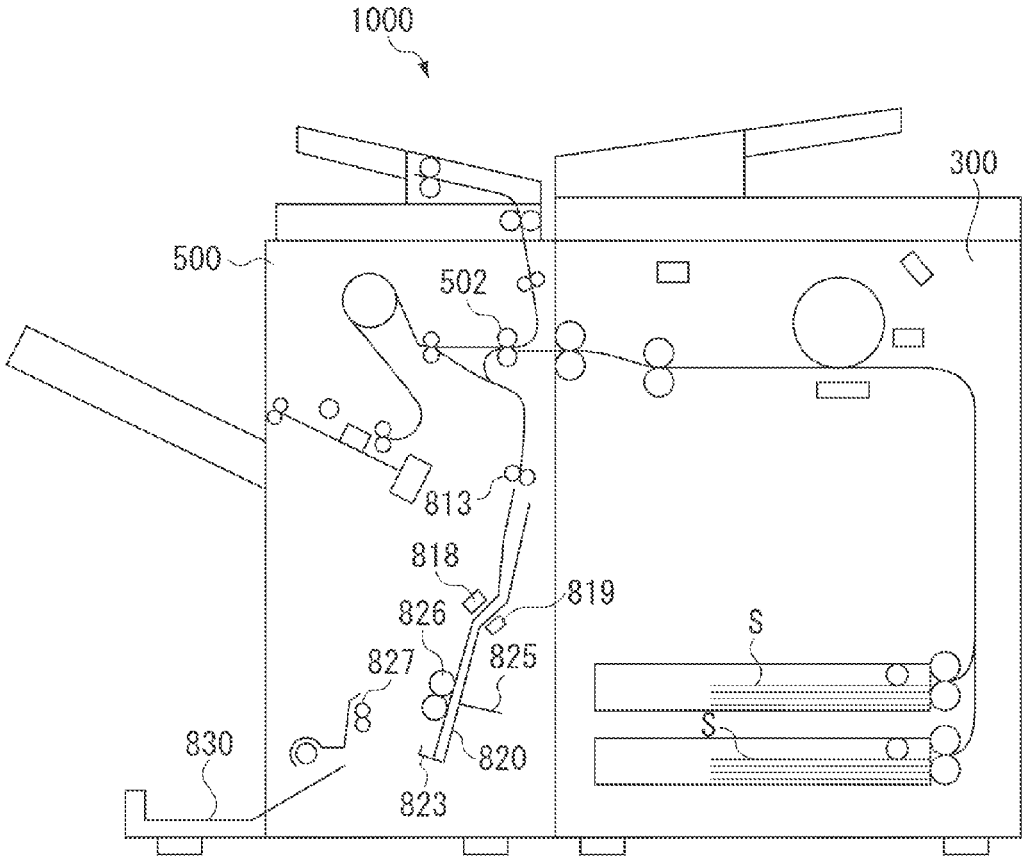
FIG. 1 is across sectional view illustrating an image forming apparatus according to a first exemplary embodiment.

FIG. 1 is across sectional view illustrating an image forming apparatus 1000 including a sheet processing apparatus 500 according to a first exemplary embodiment. The image forming apparatus 1000 includes an electro-photographic printer unit 300 and the sheet processing apparatus (finisher) 500. The sheet processing apparatus 500 and the electro-photographic printer unit 300 may be integrated. In the present exemplary embodiment, the electro-photographic printer unit 300 has been used. However, an inkjet printer may also be used.

A sheet discharged from the electro-photographic printer unit 300 after an image is formed with the electro-photographic printer unit 300 as an image forming unit is conveyed into the sheet processing apparatus 500 by an entrance roller pair 502. When bookbinding processing is designated by an operation unit (not illustrated), the sheet is conveyed to a storage guide 820 via a bookbinding roller pair 813 and conveyed until the leading edge of the sheet is brought into contact with a movable sheet positioning member 823. On the downstream side of the bookbinding roller pair 813, more particularly, in the middle position of the storage guide 820, two pairs of a stapler 818 are provided. In a position opposite to the stapler 818, an anvil 819 is provided. The stapler 818 is configured to bind the center of the sheet bundle in cooperation with the anvil 819.

Figure 2:
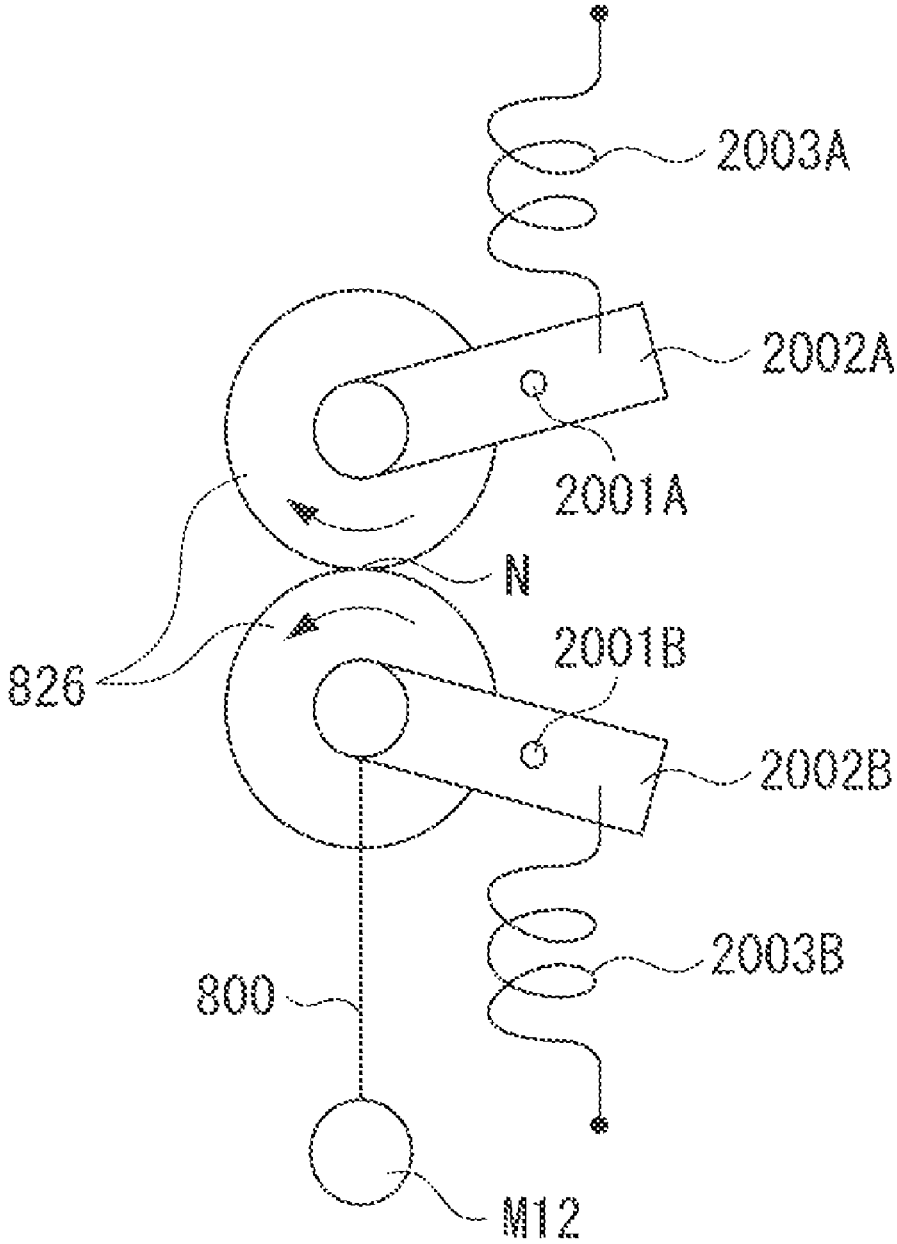
FIG. 2 is a schematic diagram illustrating a folding roller pair.

On the downstream side of the stapler 818, a folding roller pair 826 that constitutes a folding unit is provided. In FIG. 2, a schematic diagram of the folding roller pair 826 is illustrated. The folding roller pair 826 is subjected to rotation driving in directions of arrows by a folding motor M12. Rollers of the folding roller pair 826 are attached to shafts 2001A and 2001B, respectively, so as to allow swinging and supported by support members 2002A and 2002B so as to allow rotation, as illustrated in FIG. 2. The support members 2002A and 2002B are elastically biased by springs 2003A and 2003B, respectively. This configuration forms a nip portion N for nipping a sheet between both the rollers. The drive of the folding motor M12 is transmitted to the folding roller pair 826 via a gear train 800. Each roller of the folding roller pair 826 can be provided with a reverse prevention mechanism using a one way clutch or the like such that the folding roller pair 826 does not reversely rotate against the rotation direction (direction of the arrow) for conveying the sheet bundle.

In a position opposite to the folding roller pair 826, a pushing plate 825 as a sheet pushing member, which constitutes a folding unit together with the folding roller pair 826, is provided. When a pushing motor M13 (FIG. 3) is driven in forward and reverse directions, the pushing plate 825 performs a pushing operation and a returning operation, respectively. When the pushing plate 825 is projected toward a portion between both ends of a sheet or a sheet bundle stored in the storage guide 820, the sheet bundle is pushed out to the nip portion N of the folding roller pair 826. The pushed-out sheet bundle is conveyed while being folded by the folding roller pair 826. In the present exemplary embodiment, a direct current (DC) motor is used as the pushing motor M13. The DC motor can be driven in each of forward and reverse rotation directions. The configuration of the pushing plate 825 and the folding operation of a sheet bundle by the folding roller pair 826 will be described below in detail.

The sheet or sheet bundle conveyed from the nip portion N of the folding roller pair 826 is discharged to a discharge tray 830 by a folding sheet discharge roller pair 827.

Figure 3:
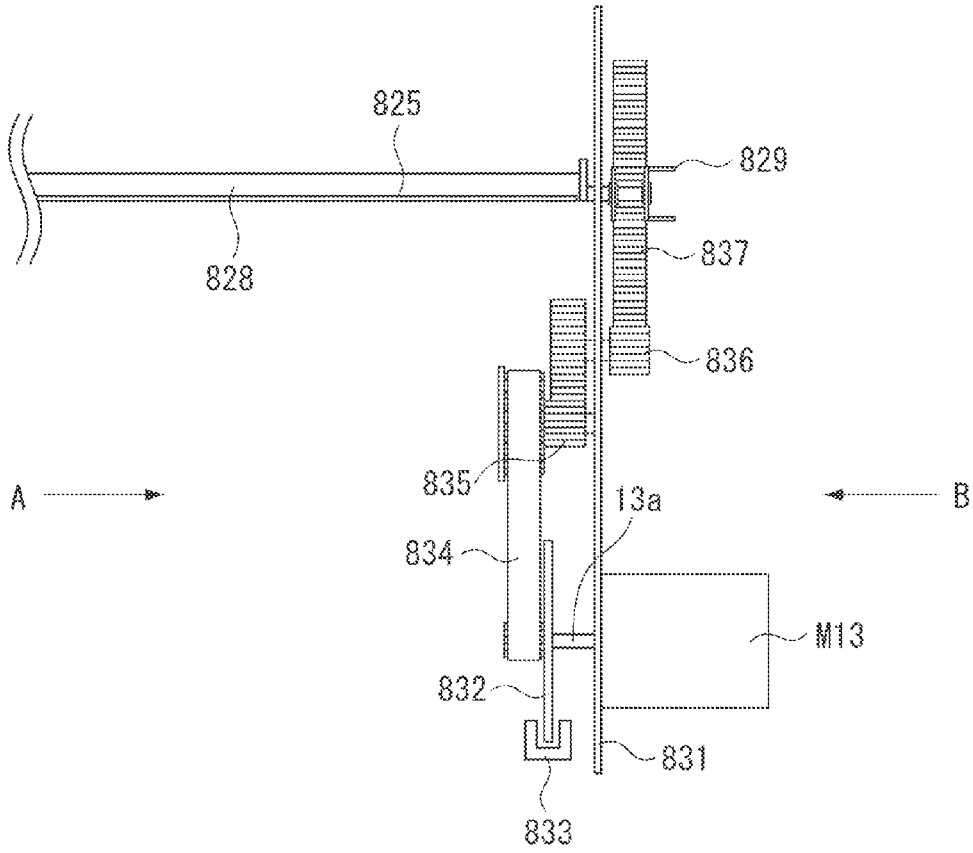
FIG. 3 is a schematic diagram illustrating a pushing plate driving unit.
Figure 4A:
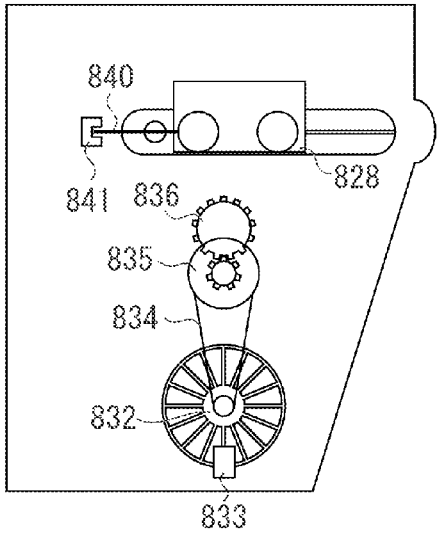
FIGS. 4A and 4B are partial diagrams in FIG. 3 when a pushing motor is stopped.
Figure 4B:
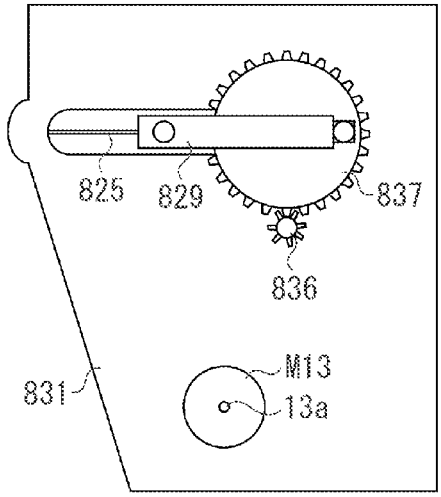

Next, the driving mechanism for the pushing plate 825 will be described. FIG. 3 is a block diagram illustrating a pushing plate driving unit. Further, FIGS. 4A and 4B are partial diagrams in FIG. 3. FIG. 4A is a diagram illustrating the pushing plate driving unit as viewed from the direction of arrow A in FIG. 3. FIG. 4B is a diagram illustrating the pushing plate driving unit as viewed from the direction of arrow B in FIG. 3. The diagrams illustrated in FIGS. 4A and 4B illustrate a state before the pushing plate 825 starts pushing drive. The position of the pushing plate 825 in a state in which the tip of the pushing plate 825 is located away from the nip portion N of the folding roller pair 826 is set as a home position (start position).

The pushing motor M13 is attached to a pushing unit frame 831. When the pushing motor M13 as a driving source is driven, a pulley-integrated pushing motor encoder 832 attached to an output shaft 13*a* rotates. When the pushing motor encoder 832 rotates by driving of the pushing motor M13, a pulse signal is output from a pushing motor encoder sensor 833. When driving of the pushing motor M13 stops, output of the pulse signal from the pushing motor encoder sensor 833 also stops. The position of the pushing plate 825 is determined using the number of pulse signals N output from the pushing motor encoder sensor 833, which is a detection unit, as the detected result. Thus, driving of the pushing plate 825 is controlled according to whether the tip of the pushing plate 825 reaches a predetermined position.

Figure 5A:
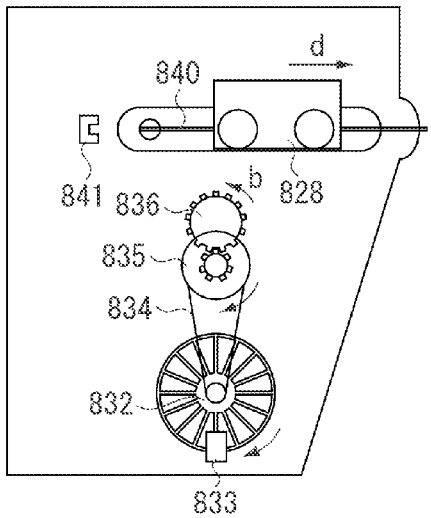
FIGS. 5A and 5B are partial diagrams in FIG. 3 when a pushing motor is driven.
Figure 5B:
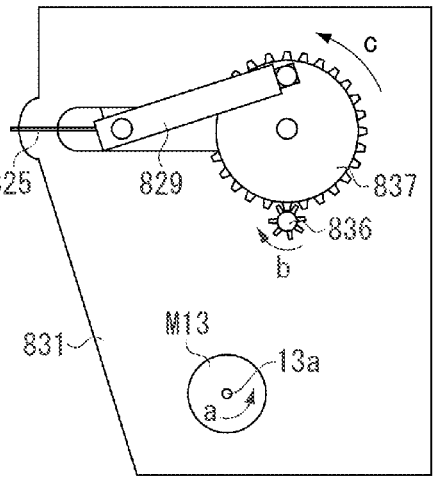

The rotation of the pushing motor M13 is transmitted to a driving gear 835 with a belt 834. When the driving gear 835 rotates, rotation is transmitted to an intermediate gear 836 via a connection member and, further, rotation is transmitted to a pushing plate driving gear 837 meshing with the intermediate gear 836. FIGS. 5A and 5B are diagrams illustrating a state in which the pushing motor M13 is driven from the state in FIGS. 4A and 4B and the pushing plate 825 is being driven. In FIGS. 5A and 5B, when the pushing motor M13 is driven in the direction of arrow a, the intermediate gear 836 rotates in the direction of arrow b, and the pushing plate driving gear 837 rotates in the direction of arrow c.

To the pushing plate driving gear 837, one end of a link support plate 829 is pivotally fixed. On the other hand, the other end of the link support plate 829 is supported by a guide (not illustrated) to be movable in a reciprocating manner and is pivotally fixed to a pushing plate unit 828 to which the pushing plate 825 is attached. Being coupled with rotation of the pushing plate driving gear 837 in the direction of arrow c, the link support plate 829 operates to move the pushing plate unit 828 and the pushing plate 825 in the direction of arrow d from the home position.

As described above, the pushing plate 825 is moved in the direction of arrow d, thereby performing the pushing operation to push the sheet bundle into the nip portion of the folding roller pair 826.

The returning operation when the pushing plate 825 is returned from the state in which the sheet bundle is pushed to the home position is performed by rotating the pushing motor M13 in the direction opposite to arrow a. On the downstream side in a pushing operation direction of the pushing plate 825, a pushing plate home position sensor 841 to detect whether the pushing plate 825 is located in the home position is installed. When the pushing plate 825 performs the returning operation and returns to the home position, the pushing plate home position sensor 841 detects a flag 840 attached to the pushing plate unit 828, and, then, driving of the pushing motor M13 is stopped.

Figure 6:
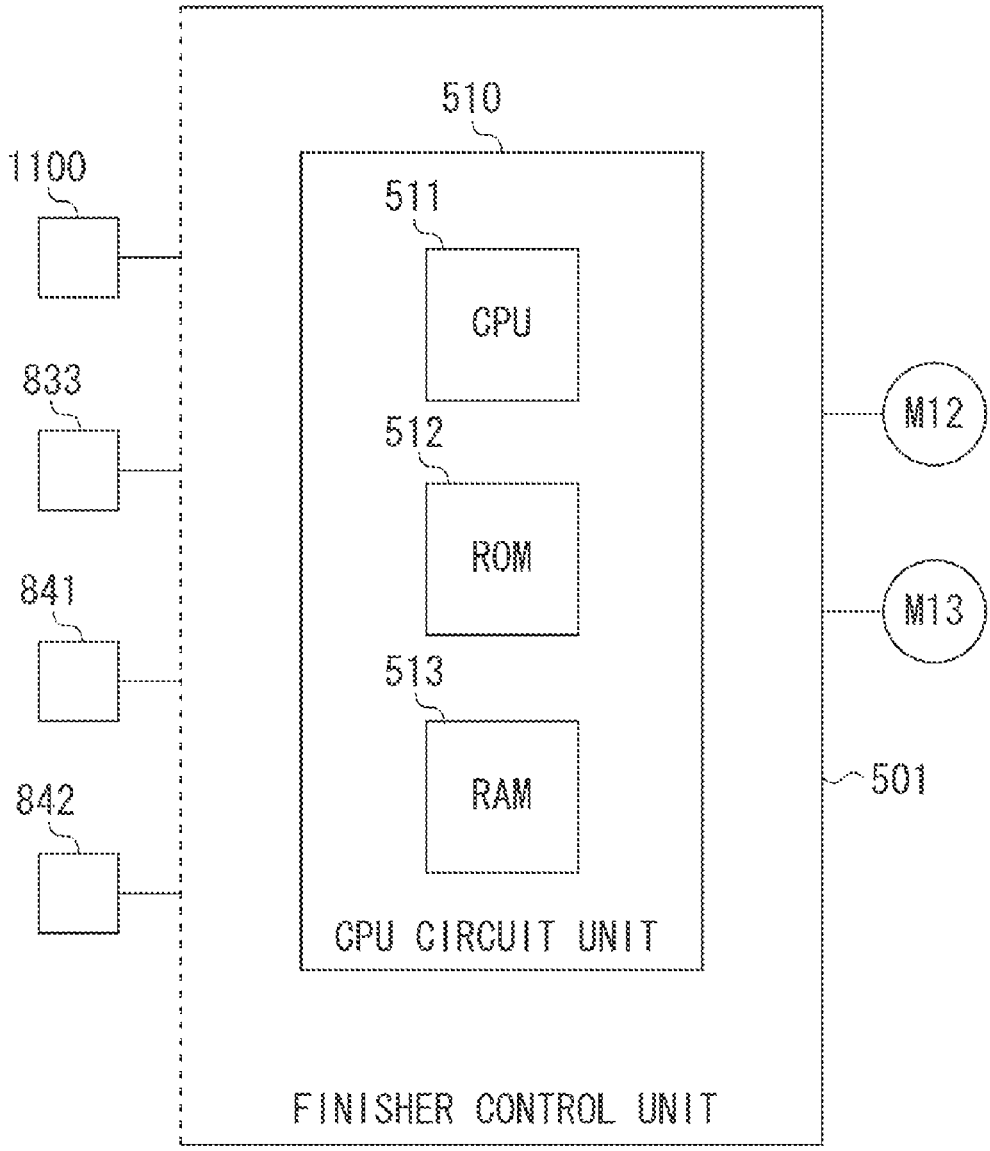
FIG. 6 is a block diagram illustrating a finisher control unit.

Next, a method for controlling the sheet processing apparatus 500 will be described. FIG. 6 illustrates a configuration of a finisher control unit 501. The finisher control unit 501 includes a central processing unit (CPU) circuit unit 510, which includes a CPU 511, a read only memory (ROM) 512, a random access memory (RAM) 513, and the like, as an information processing unit. Based on instructions from a CPU circuit unit (not illustrated) provided on the image forming apparatus main body side, various programs stored in the ROM 512 are executed, and drive control for the sheet processing apparatus 500 is executed.

When drive control for the sheet processing apparatus 500 is executed, detection signals are input from various types of sensors to the CPU circuit unit 510. The various types of sensors include the pushing motor encoder sensor 833, the pushing plate home position sensor 841, and a timer 842. Further, based on signals from the CPU circuit unit 510, various types of motors such as the folding motor M12, which is a driving source for the folding roller pair 826 and the folding sheet discharge roller pair 827, and the pushing motor M13, which is a driving source for the pushing plate 825, are driven. In the present exemplary embodiment, the finisher control unit 501 is provided on the sheet processing apparatus 500. However, the finisher control unit 501 may be integrally provided on the CPU circuit unit mounted on the image forming apparatus main body side.

The sheet processing apparatus 500 can be subjected to drive control directly from the CPU circuit unit mounted on the image forming apparatus main body side or via the finisher control unit 501 mounted on the sheet processing apparatus 500. In either case, the drive control can similarly be executed. However, it is more useful to mount the finisher control unit 501 on the sheet processing apparatus 500 as an option, because the control unit on the image forming apparatus main body side can be kept to the minimum necessary.

Next, a folding operation according to the present exemplary embodiment will be described.

FIGS. 7A to 7G are schematic diagrams chronologically (a→b→ . . . →g) illustrating the folding operation according to the present exemplary embodiment. Further, FIG. 8 is a flowchart illustrating folding control processing according to the present exemplary embodiment. The folding control processing according to the present exemplary embodiment will be described below with reference to FIGS. 7A to 7G and FIG. 8.

Figure 7A:
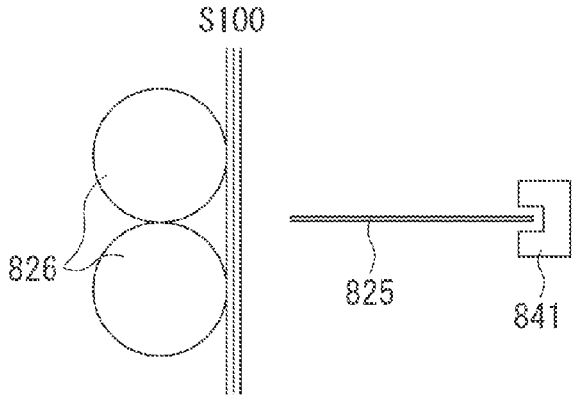
FIGS. 7A to 7G are schematic diagrams chronologically illustrating a folding operation according to the first exemplary embodiment.
Figure 8:
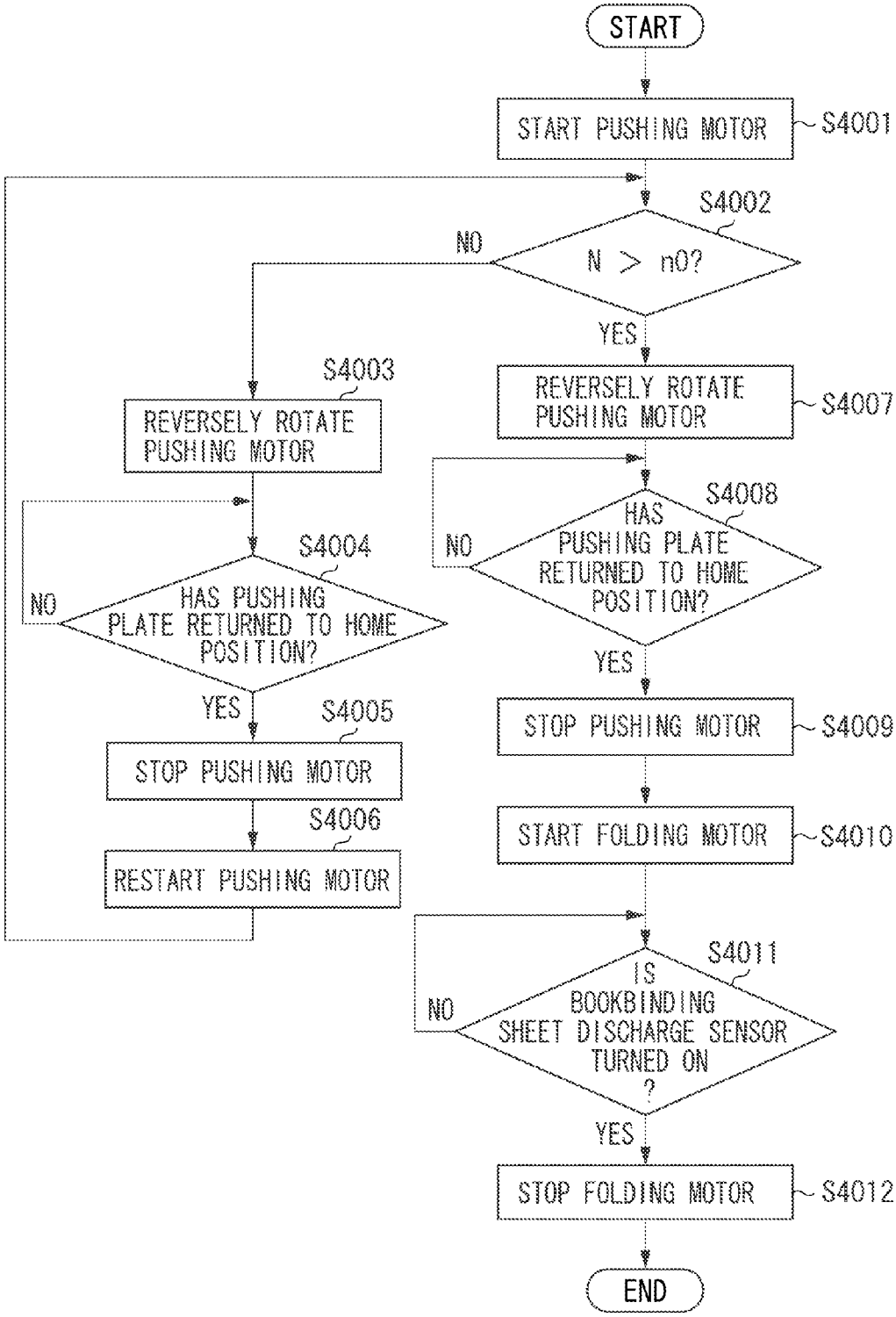
FIG. 8 is a flowchart illustrating folding control processing according to the first exemplary embodiment.

In FIG. 7A, a sheet bundle 5100 including the number of sheets set by an operator is stacked on the sheet positioning member 823. FIG. 7A illustrates a state before a pushing operation is performed by the pushing plate 825. In this state, the pushing plate 825 is stopped in the home position.

When the folding control processing is started, then in step S4001, the pushing motor M13 starts forward rotation driving and the pushing plate 825 moves forward toward the nip portion of the folding roller pair 826. When a predetermined time t elapses after the pushing motor M13 starts the forward rotation driving, then in step S4002, the CPU circuit unit 510 determines whether the number of pulses N output from the pushing motor encoder sensor 833 within the predetermined time t is larger than a predetermined value n0. The predetermined value n0 is set to a value used to determine whether the tip of the pushing plate 825 reaches a predetermined position in a moving direction when the pushing plate 825 performs the pushing operation. More particularly, the predetermined value n0 is set so as to become N>n0 when the tip of the pushing plate 825 exceeds the predetermined position in the direction of the pushing operation within the predetermined time t and to become N≦n0 when the tip of the pushing plate 825 does not exceed the predetermined position. The predetermined time t is a period of time to be required until the tip of the pushing plate 825 reaches the above-described predetermined position from the home position in the pushing operation of one time by the pushing plate 825. Further, when the tip of the pushing plate 825 reaches the above-described predetermined position, a portion of the sheet bundle pushed by the tip of the pushing plate 825 expands the interval of the folding roller pair 826 and is then pushed into the nip portion N of the folding roller pair 826. Preferably, this predetermined position is a position where the tip of the pushing plate 825 exceeds a line 848 which connects the center axes of the respective rollers of the folding roller pair 826 in a moving direction when the pushing plate 825 performs the pushing operation.

Figure 7B:
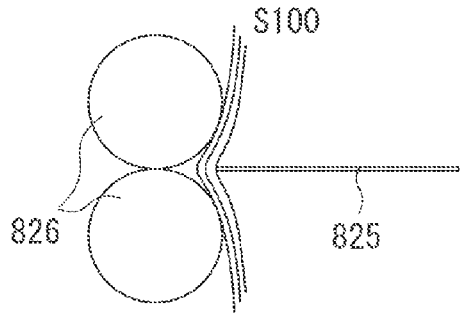

When the number sheets of the sheet bundle 5100 is large or a sheet high in stiffness is included therein, even if the sheet bundle 5100 is intended to be pushed into the nip portion of the folding roller pair 826 by the pushing plate 825, since torque of the pushing motor M13 is insufficient, the rotation of the pushing motor M13 stops. Thus, the pushing plate 825 may stop in a position as illustrated in FIG. 7B.

Figure 7C:
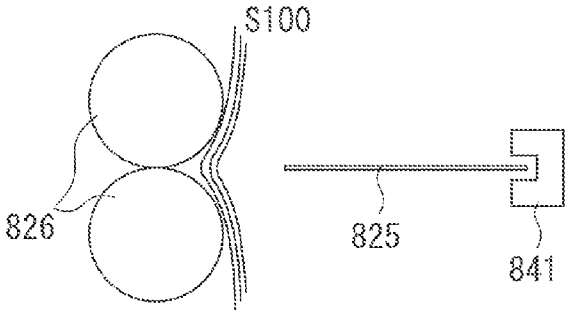
Figure 7D:
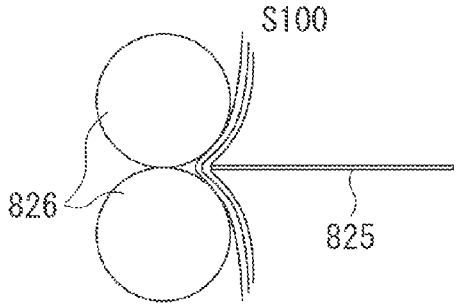
Figure 7E:
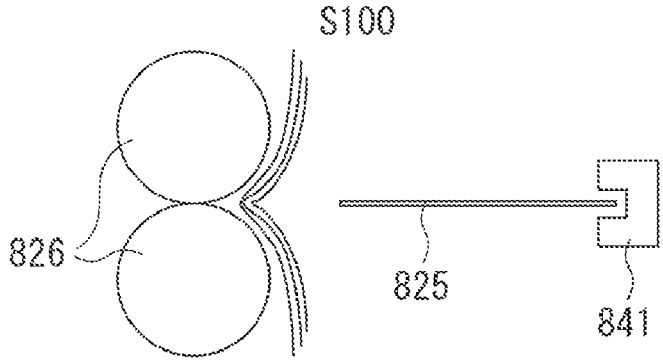

If the number of pulses N output from the pushing motor encoder sensor 833 within the predetermined time t is equal to or less than the predetermined value n0 (NO in step S4002), then in step S4003, the CPU circuit unit 510 reversely rotates the pushing motor M13. Then, as illustrated in FIG. 7C, the CPU circuit unit 510 causes the pushing plate 825 to move backward to return to the home position. When the pushing plate 825 returns to the home position (YES in step S4004), then in step S4005, the CPU circuit unit 510 stops the reverse rotation of the pushing motor M13. Thereafter, in step S4006, the CPU circuit unit 510 restarts the pushing motor M13 in the direction of forward rotation to restart the pushing operation by the pushing plate 825. Until the number of pulses N output from the pushing motor encoder sensor 833 exceeds the predetermined value n0 within the predetermined time t after the pushing plate 825 restarts the pushing operation, the CPU circuit unit 510 repeats the operation in steps S4003 to S4006. As illustrated in FIGS. 7D and 7E, when the pushing operation is repeated, a portion of the sheet bundle S100 pushed by the pushing plate 825 becomes bent.

Figure 7F:
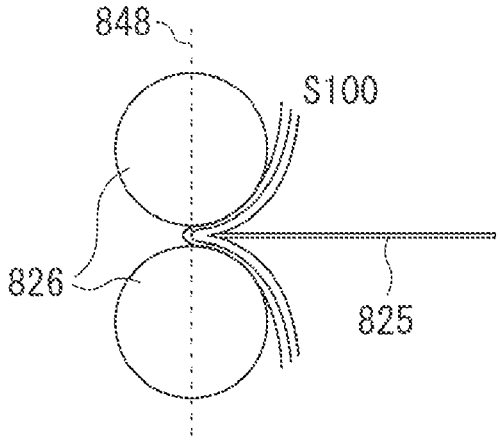
Figure 7G:
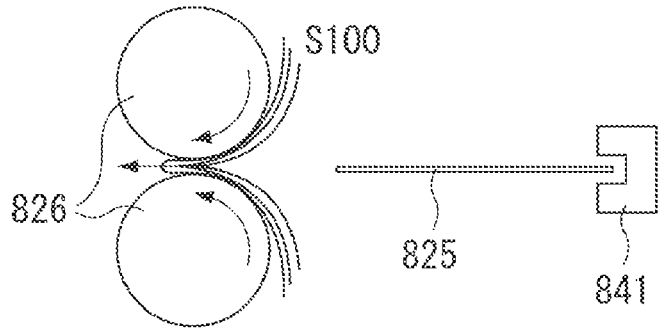

If the number of pulses N output from the pushing motor encoder sensor 833 exceeds the predetermined value n0 (YES in step S402), then, as illustrated in FIG. 7F, the sheet bundle S100 becomes pushed into the nip portion of the folding roller pair 826. In step S4007, the CPU circuit unit 510 reversely rotates the pushing motor M13. In step S4008, as illustrated in FIG. 7G, the CPU circuit unit 510 causes the pushing plate 825 to move backward to return to the home position. When the pushing plate 825 returns to the home position (YES in step S4008), then in step S4009, the CPU circuit unit 510 stops the pushing motor M13. Thereafter, in step S4010, the CPU circuit unit 510 starts the folding motor M12. Thus, the folding roller pair 826 is subjected to rotation driving, the sheet bundle 5100 is conveyed to the folding roller pair 826, and the sheet bundle S100 is discharged to the discharge tray 830. If the bookbinding sheet discharge sensor (not illustrated) provided on the downstream in a conveyance direction of the sheet bundle S100 detects the sheet bundle 5100 (YES in step S4011), then in step S4012, the CPU circuit unit 510 stops the folding motor M12 to stop the rotation driving of the folding roller pair 826. The folding motor M12 is started after the pushing plate 825 returns to the home position and driving of the pushing motor M13 stops. However, timing to start the folding motor M12 may be timing to start backward movement of the pushing plate 825 or timing in the middle of backward movement of the pushing plate 825.

Figure 9:
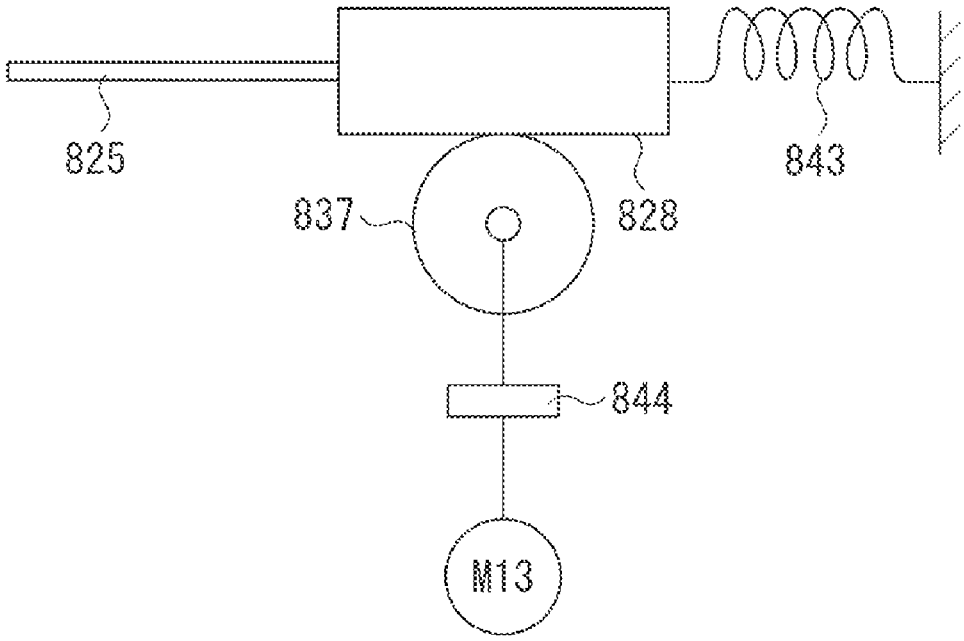
FIG. 9 is a schematic diagram illustrating another pushing plate driving configuration according to the first exemplary embodiment.
Figure 10:
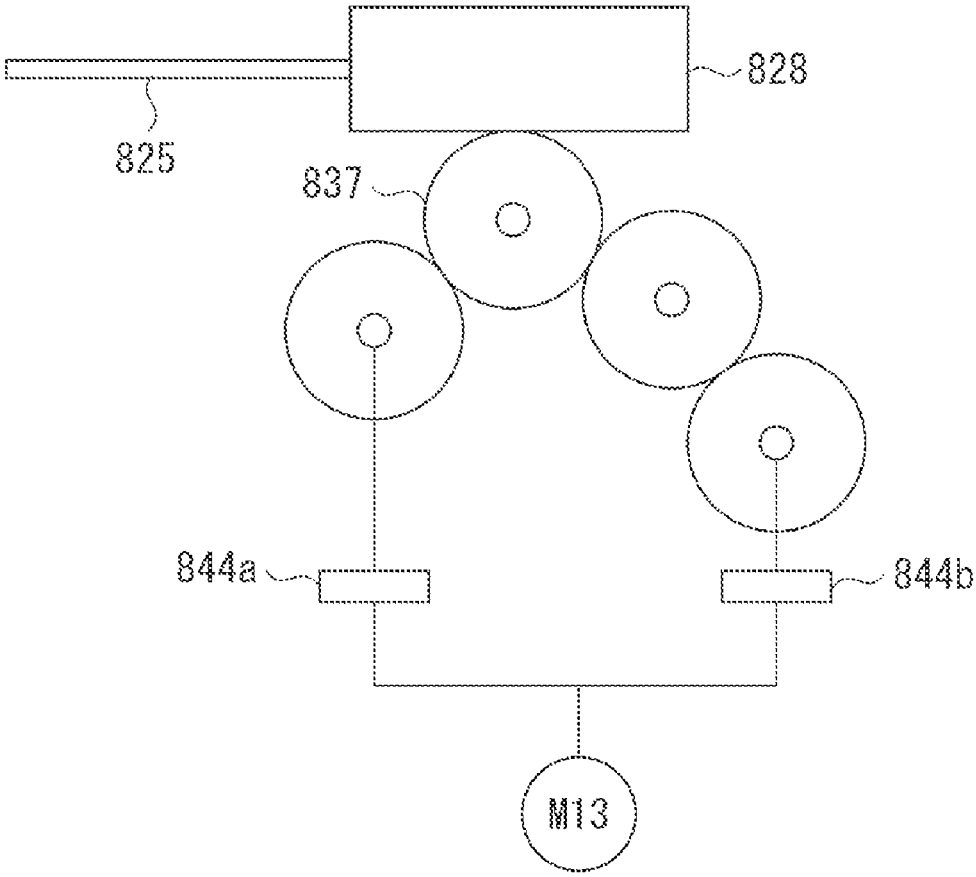
FIG. 10 is a schematic diagram illustrating yet another pushing plate driving configuration according to the first exemplary embodiment.

Further, in the present exemplary embodiment, a pushing motor capable of rotating in both forward and reverse directions is used but is not limited to this. Even when a motor capable of rotating only in one direction is used, if an apparatus configuration is employed to allow control both in a direction of pushing the pushing plate 825 and in a direction of returning it, an effect similar to the present exemplary embodiment can be obtained. As an example thereof, in FIGS. 9 and 10, schematic diagrams of a pushing plate driving unit are illustrated. In the configuration illustrated in FIG. 9, a spring 843 is attached to the rear end of the pushing plate unit 828 to use elastic force of the spring 843 for backward movement of the pushing plate 825. Further, a clutch 844 allows transmission of drive of the pushing motor M13 to the pushing plate driving gear 837 to be controlled to switch connection and non-connection of the clutch 844 according to the pushing operation and returning operation of the pushing plate 825. Furthermore, a gear configuration as illustrated in FIG. 10 enables the pushing plate driving gear 837 to be controlled so as to be rotatable in both forward and reverse directions by switching clutches 844*a* and 844*b*.

Figure 11:
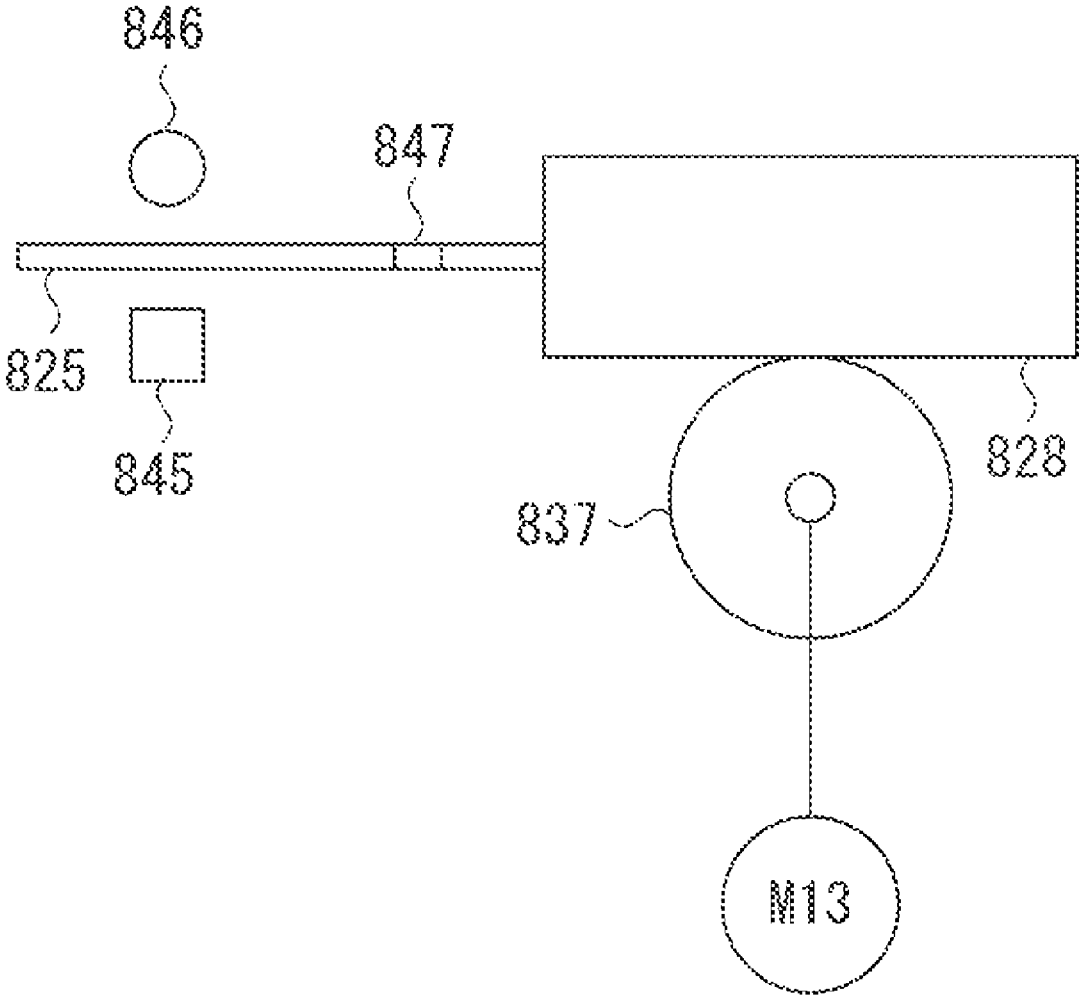
FIG. 11 is a schematic diagram illustrating another pushing plate detection configuration according to the first exemplary embodiment.

Further, in the present exemplary embodiment, as a method for detecting whether the tip of the pushing plate 825 reaches the predetermined position within the predetermined time t, the amount of operation of the pushing motor M13 is detected by detecting the number of pulses output from the pushing motor encoder sensor 833. However, the detection method is not limited to this. For example, as illustrated in FIG. 11, a hole 847 can be provided on a part of the pushing plate 825. When the hole 847 passes through the predetermined position, a sensor 845 including a photodetector can detect light from a light-emitting unit 846. This configuration enables detecting whether the hole 847 provided on the pushing plate 825 passes through the predetermined position within the predetermined time t.

In the above-described configuration according to the first exemplary embodiment, after the tip of the pushing plate 825 reaches the nip portion of the folding roller pair 826, the folding motor M12 is started and the folding roller pair 826 is subjected to rotation driving. However, when the pushing plate 825 performs the pushing operation, even if the tip of the pushing plate 825 does not reach the nip portion of the folding roller pair 826 and the folding roller pair 826 is not driven, the folding roller pair 826 may be rotated by the pushing operation of the pushing plate 825. At this time, an outermost sheet of the sheet bundle may be dragged by friction force with the folding roller pair 826. Thus, damage such as a wrinkle and a break of the sheet may occur.

In a second exemplary embodiment, a stepping motor is used as a folding motor and/or a brake is used. Thus, driven rotation of the folding roller pair 826 by the pushing operation of the pushing plate 825 is prevented. This configuration allows keeping a state in which rotation of the folding roller pair 826 is stopped until the tip of the pushing plate 825 reaches the nip portion of the folding roller pair 826 and driving of the folding motor is started. Retaining the state in which rotation of the folding roller pair 826 is stopped until the tip of the pushing plate 825 reaches the nip portion of the folding roller pair 826 allows fold processing to be securely performed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A sheet processing apparatus, comprising:

a folding roller pair configured to fold a sheet or a sheet bundle by a nip portion and to convey a folded sheet or a folded sheet bundle;

a sheet pushing member configured to perform a pushing operation in which a tip of the sheet pushing member pushes the sheet or the sheet bundle into the nip portion of the folding roller pair;

a driving unit configured to drive the sheet pushing member to perform the pushing operation;

a detection unit configured to detect whether the tip of the sheet pushing member reaches a predetermined position in a moving direction of the sheet pushing member; and a control unit configured to control the driving unit according to a result of detection by the detection unit so that the sheet pushing member repeats the pushing operation until the detection unit detects that the tip of the sheet pushing member reaches the predetermined position.

2. The sheet processing apparatus according to claim 1, wherein the detection unit detects whether the tip of the sheet pushing member reaches the predetermined position by detecting an operation amount of the driving unit.

3. The sheet processing apparatus according to claim 1, wherein the detection unit detects whether the tip of the sheet pushing member reaches the predetermined position by detecting a part of the sheet pushing member.

4. The sheet processing apparatus according to claim 1, wherein the control unit controls the driving unit to retain the folding roller pair in a state of rotation stop until the detection unit detects that the tip of the sheet pushing member reaches the predetermined position.

5. An image forming apparatus, comprising:

an image forming unit configured to form an image on a sheet;

a control unit configured to control a sheet processing apparatus; and the sheet processing apparatus, wherein the sheet processing apparatus is configured to process the sheet on which the image has been formed and includes:

a folding roller pair configured to fold a sheet or a sheet bundle by a nip portion and to convey a folded sheet or a folded sheet bundle, a sheet pushing member configured to perform a pushing operation in which a tip of the sheet pushing member pushes a portion between two ends of the sheet or two ends of the sheet bundle into the nip portion of the folding roller pair, a driving unit configured to drive the sheet pushing member to perform the pushing operation, and a detection unit configured to detect whether the tip of the sheet pushing member reaches a predetermined position in a moving direction of the sheet pushing member, wherein the control unit controls the driving unit according to a result of detection by the detection unit so that the sheet pushing member repeats the pushing operation until the detection unit detects that the tip of the sheet pushing member reaches the predetermined position.

6. The image forming apparatus according to claim 5, wherein the detection unit detects whether the tip of the sheet pushing member reaches the predetermined position by detecting an operation amount of the driving unit.

7. The image forming apparatus according to claim 5, wherein the detection unit detects whether the tip of the sheet pushing member reaches the predetermined position by detecting a part of the sheet pushing member.

8. The image forming apparatus according to claim 5, wherein the control unit controls the driving unit to retain the folding roller pair in a state of rotation stop until the detection unit detects that the tip of the sheet pushing member reaches the predetermined position.

* * * * *